US008505728B2

(12) United States Patent
Su

(10) Patent No.: US 8,505,728 B2
(45) Date of Patent: Aug. 13, 2013

(54) PORTABLE TOOL STORING DEVICE

(76) Inventor: Chung-Hsiu Su, Kaohsiung (TW)

( * ) Notice: Subject to any disclaimer, the term of this patent is extended or adjusted under 35 U.S.C. 154(b) by 147 days.

(21) Appl. No.: 13/223,913

(22) Filed: Sep. 1, 2011

(65) Prior Publication Data

US 2013/0056378 A1 Mar. 7, 2013

(51) Int. Cl.

| | |
|---|---|
| ***B65D 21/00*** | (2006.01) |
| *B65D 73/00* | (2006.01) |
| *B65D 21/02* | (2006.01) |
| *B65D 25/24* | (2006.01) |

(52) U.S. Cl.

USPC ..... 206/499; 206/486; 220/23.4; 220/480; 220/482

(58) Field of Classification Search

USPC ..... 211/70.6, 84, 85.17, 88.01, 86.01, 211/189, 49.1, 71.01, 90.01, 90.02, 90.04, 211/133.3, 133.1, 193; 248/231.81, 225.21, 248/301, 305; 206/486, 372, 373, 216, 499; 220/23.4, 476, 480, 481, 482; 312/107, 111

See application file for complete search history.

(56) References Cited

U.S. PATENT DOCUMENTS

| | | | | |
|---|---|---|---|---|
| 699,906 | A * | 5/1902 | Williams | 296/4 |
| 895,867 | A * | 8/1908 | Kirk | 211/84 |
| 1,715,163 | A * | 5/1929 | Kim | 248/134 |
| 1,884,445 | A * | 10/1932 | Wever | 206/728 |
| 2,245,873 | A * | 6/1941 | Ritz-Woller | 211/4 |
| 2,595,752 | A * | 5/1952 | Batts | 248/224.8 |
| 2,635,762 | A * | 4/1953 | Shaw | 211/85.17 |
| 2,743,021 | A * | 4/1956 | Glenn | 211/72 |
| 3,047,158 | A * | 7/1962 | Scholl | 211/85.17 |
| 3,661,271 | A * | 5/1972 | Fisher et al. | 211/88.01 |
| 3,908,831 | A * | 9/1975 | Brendgord | 211/88.01 |
| 4,160,570 | A * | 7/1979 | Bridges | 312/245 |
| 4,720,021 | A * | 1/1988 | Byrns | 220/764 |
| 4,984,704 | A * | 1/1991 | O'Malley | 220/23.4 |
| 5,111,944 | A * | 5/1992 | Ostermeyer | 211/133.1 |
| 5,547,080 | A * | 8/1996 | Klimas | 206/373 |
| 6,076,663 | A * | 6/2000 | Shima | 206/216 |
| 6,394,297 | B1 * | 5/2002 | Nance | 220/23.4 |
| 6,837,383 | B1 * | 1/2005 | McElhaney, Jr. | 211/70.6 |
| 6,935,520 | B1 * | 8/2005 | Lund | 211/181.1 |
| 7,416,160 | B2 * | 8/2008 | Cies | 248/213.2 |
| 7,722,515 | B2 * | 5/2010 | McMurty et al. | 483/59 |
| 7,753,218 | B2 * | 7/2010 | Moss et al. | 211/133.3 |
| 7,802,680 | B2 * | 9/2010 | Krebs et al. | 206/349 |
| 7,878,358 | B2 * | 2/2011 | Smudde | 220/23.88 |
| 8,056,737 | B2 * | 11/2011 | Kao | 211/70.6 |
| 8,267,247 | B1 * | 9/2012 | Horiyama | 206/373 |
| 2002/0088729 | A1 * | 7/2002 | Urbanski | 206/373 |
| 2004/0211739 | A1 * | 10/2004 | Lembe | 211/133.1 |
| 2010/0006521 | A1 * | 1/2010 | VerHage et al. | 211/71.01 |
| 2010/0044328 | A1 * | 2/2010 | Barkdoll et al. | 211/88.01 |
| 2011/0266283 | A1 * | 11/2011 | Ernst et al. | 220/476 |

(Continued)

*Primary Examiner* — Joshua J Michener
*Assistant Examiner* — Devin Barnett
(74) *Attorney, Agent, or Firm* — Brinks Hofer Gilson & Lione

(57) ABSTRACT

A portable tool storing device includes first and second modular shelves configured to be brought into fitting engagement with each other in an upright direction by a back-to-back engagement manner so as to permit crosspieces to be juxtaposed to and combined with each other to form a handle for carrying. Each shelf includes a plurality of flank segments, each having an indented region. A modular container has a clip lug disposed to be clipped on the indented region to detachably hold the container on the flank segment so as to provide easy access to a tool in the container body.

7 Claims, 6 Drawing Sheets

(56) References Cited

U.S. PATENT DOCUMENTS

2012/0091088 A1* 4/2012 Didehvar et al. ..... 211/113
2012/0228300 A1* 9/2012 Wertman ..... 220/476
2012/0241397 A1* 9/2012 Strollo ..... 211/71.01

* cited by examiner

PORTABLE TOOL STORING DEVICE

BACKGROUND OF THE INVENTION

1. Field of the Invention

This invention relates to a portable tool storing device, more particularly to a portable tool storing device for storing tools in modular containers.

2. Description of the Related Art

In U.S. Pat. No. 6,076,663 as shown in FIG. 1, there is disclosed a portable tool storing device, which includes a carrier for holding a plurality of accumulating containers 6 that accommodate small items. The carrier is formed by two flat-shaped box bodies 4 which are superimposed to each other, and which have a plurality of fitting holes 43 such that the containers 6 are fitted to the fitting holes 43 to permit covers 62 of the opposing containers 6 to be stacked on each other. The box bodies 4 are pivotably connected to each other at lower portions thereof to be freely opened and closed such that grip forming bodies 5 on upper portions of the box bodies 4 are juxtaposed to each other to form a handle when closed. In use, the box bodies 4 have to be opened to permit opening of the covers 62 of the containers 6 or removal of the containers 6 from the fitting holes 43, which causes inconvenience to the user.

SUMMARY OF THE INVENTION

An object of the present invention is to provide a portable tool storing device which permits convenient removal of a stored tool from a container thereof and detachment of a container from a shelf.

According to this invention, the portable tool storing device includes first and second modular shelves and a plurality of modular containers. Each of the first and second modular shelves has outward and inward surfaces opposite to each other in a transverse direction, and includes a middle wall which has a crosspiece disposed at a top end thereof, and a plurality of flank segments disposed to flank the middle wall in a longitudinal direction and spaced apart from each other in an upright direction. Each of the flank segments has an indented region offset from the inward surface in the transverse direction. The first and second modular shelves respectively have male and female joint members disposed on the inward surfaces and configured such that the middle walls of the first and second modular shelves are brought into fitting engagement with each other in the upright direction to be placed in back-to-back engagement so as to permit the crosspieces to be juxtaposed to and combined with each other so as to form a handle. Each of the modular containers includes a container body and a clip lug extending downwardly from an upper edge of the container body to be clippable on a corresponding one of the indented regions. By virtue of the flank segments disposed to flank the middle wall of the modular shelf, and by virtue of the indented regions, the clip lug of each modular container can be clipped on the indented region to detachably hold the container body on the modular shelf so as to provide easy access to a tool in the container body.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
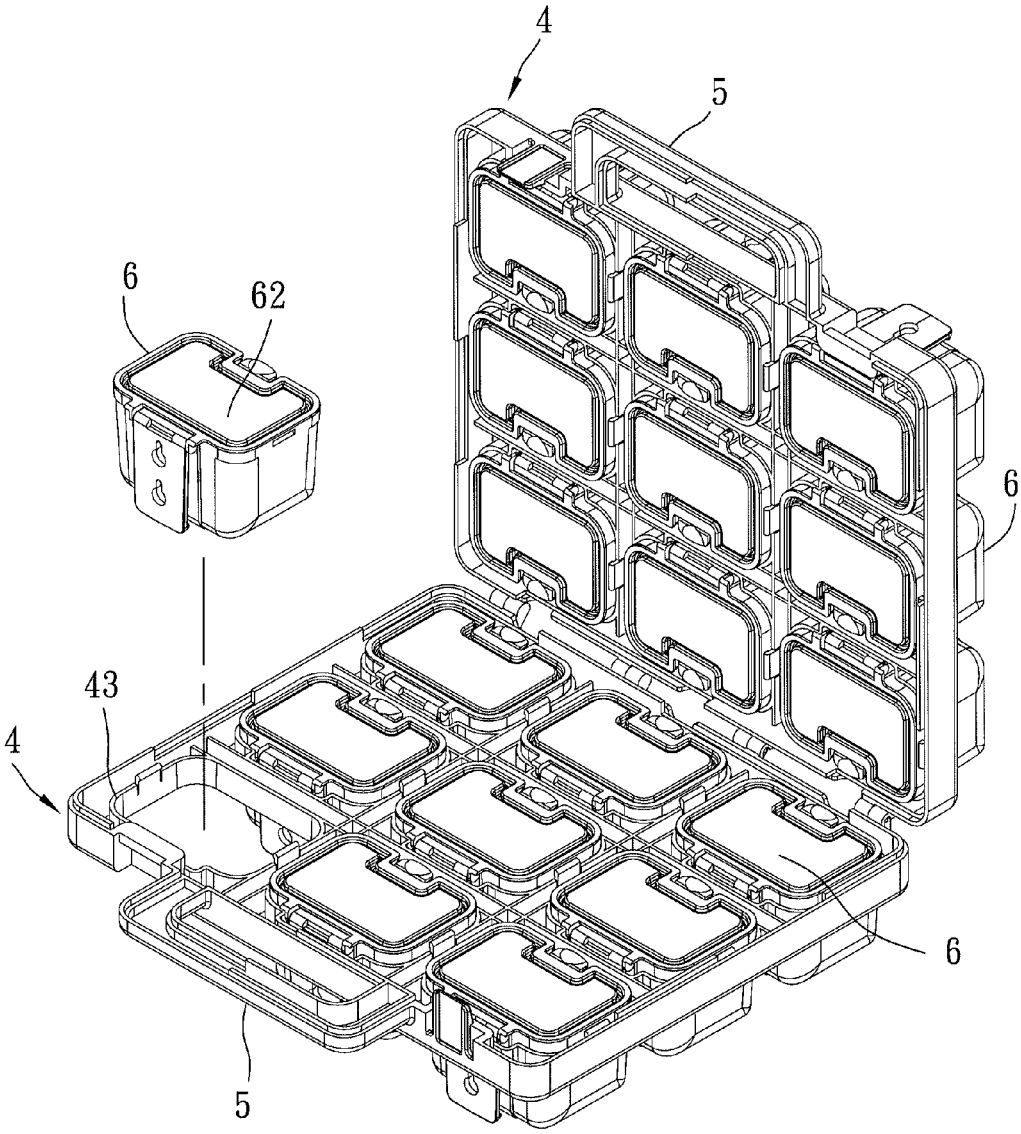
FIG. 1 PRIOR ART
FIG. 1 is a perspective view of a conventional portable tool storing device disclosed in U.S. Pat. No. 6,076,663.

Before the present invention is described in greater detail, it should be noted that same reference numerals have been used to denote like elements throughout the specification.

Figure 2:
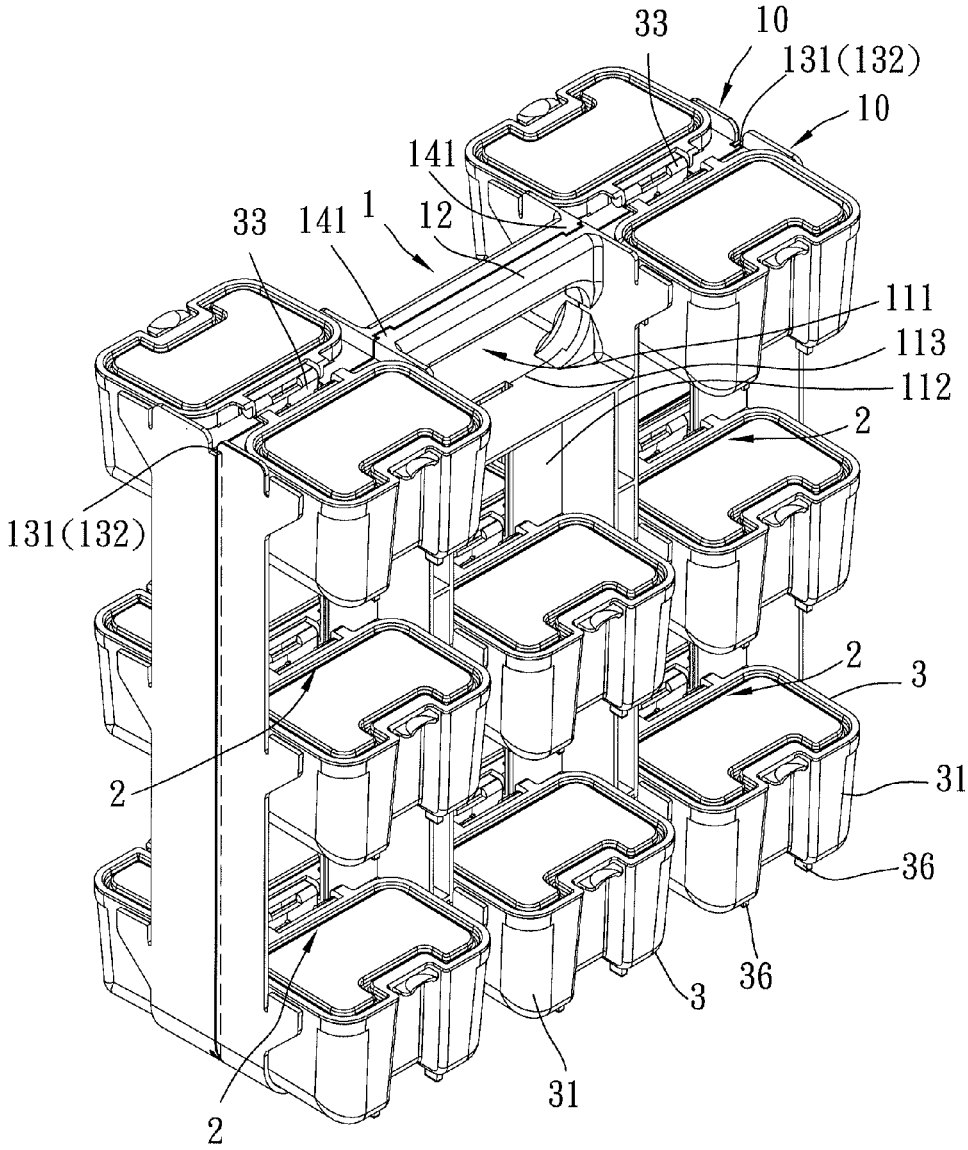
FIG. 2 is a perspective view of the first preferred embodiment of a portable tool storing device according to this invention.
Figure 4:
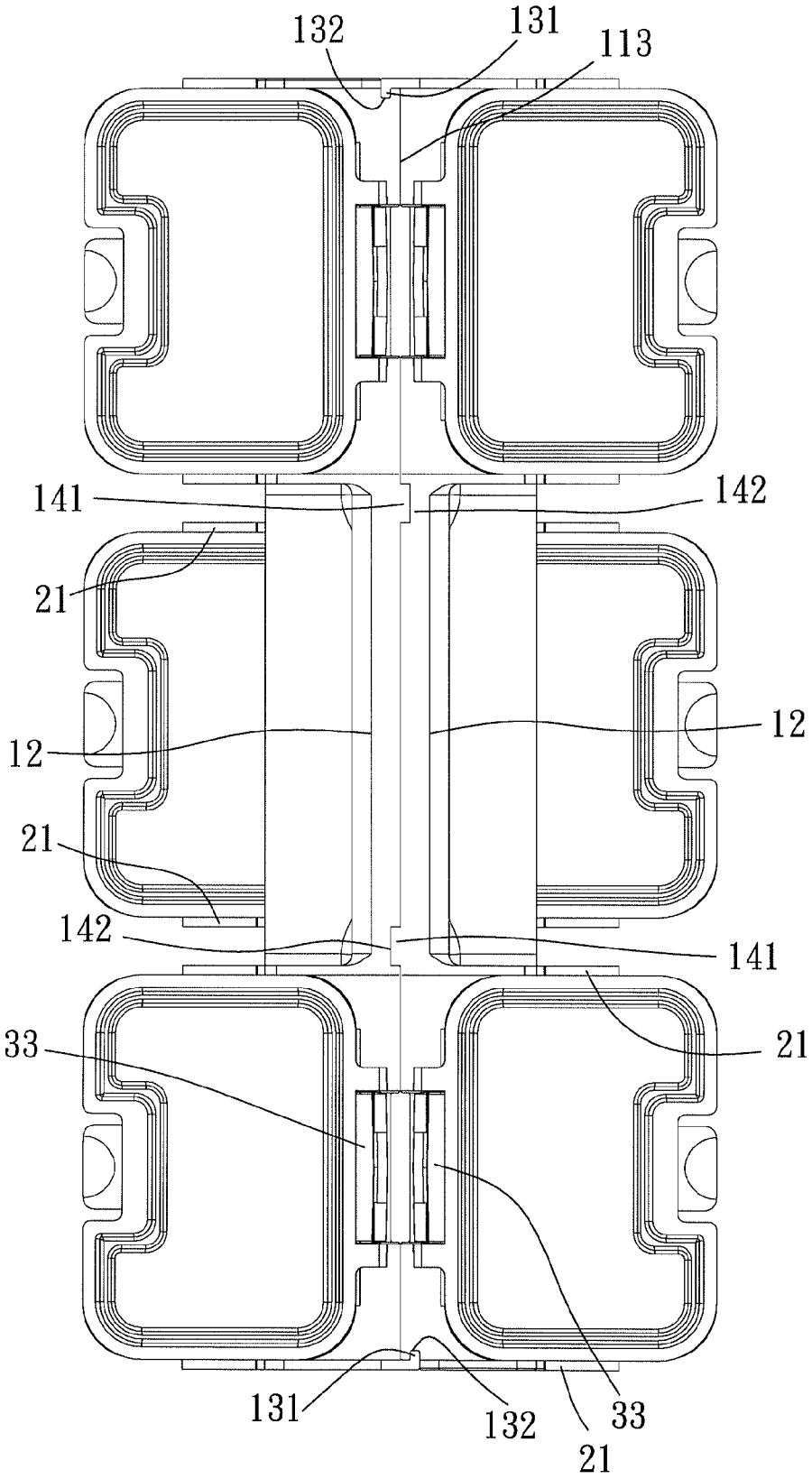
FIG. 4 is a top view of the first preferred embodiment.
Figure 5:
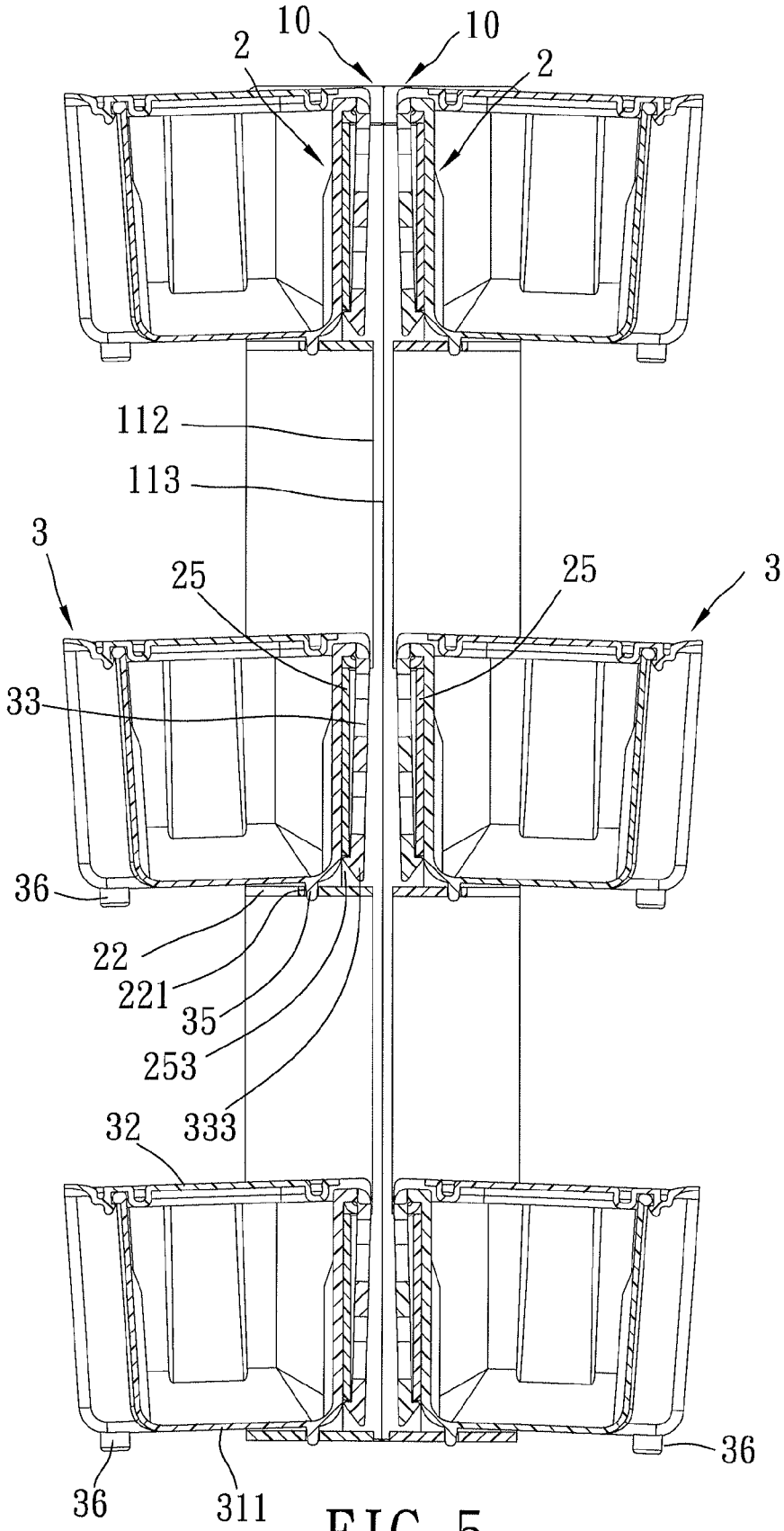
FIG. 5 is a sectional view of the first preferred embodiment.

Referring to FIGS. 2, 4 and 5, the first preferred embodiment of a portable tool storing device according to the present invention is shown to comprise first and second modular shelves 10 and a plurality of modular containers 3.

The first modular shelf 10 has first top and bottom ends opposite to each other in an upright direction, and first outward and inward surfaces 112, 113 opposite to each other in a transverse direction relative to the upright direction. The first modular shelf 10 includes a first middle wall 1 which has a first crosspiece 12 disposed at the first top end. A plurality of first flank segments 2 are disposed to flank the first middle wall 1 in a longitudinal direction transverse to the upright and transverse directions, and are spaced apart from each other in the upright direction. Each of the first flank segments 2 has a first indented region 25 which is offset from the first inward surface 113 in the transverse direction. Similarly, the second modular shelf 10 has second top and bottom ends opposite to each other in the upright direction, and second outward and inward surfaces 112, 113 opposite to each other in the transverse direction. The second modular shelf 10 includes a second middle wall 1 which has a second crosspiece 12 disposed at the second top end. A plurality of second flank segments 2 are disposed to flank the second middle wall 1 in the longitudinal direction, and are spaced apart from each other in the upright direction. Each of the second flank segments 2 has a second indented region 25 which is offset from the second inward surface 113 in the transverse direction. The first and second modular shelves 10 have male and female joint members 141, 142 disposed on the first and second inward surfaces 113, and configured such that the first and second middle walls 1 are brought into fitting engagement with each other in the upright direction to be placed in back-to-back engagement so as to permit the first and second crosspieces 12 to be juxtaposed to and combined with each other, thereby forming a handle 111, while permitting corresponding ones of the first and second indented regions 25 to confront each other in the transverse direction. In addition, end stops and mating step portions 131, 132 are disposed on the first and second inward surfaces 113 of the first and second modular shelves 10, and are engaged with each other when the first middle wall 1 is in back-to-back engagement with the second middle wall 1.

Figure 3:
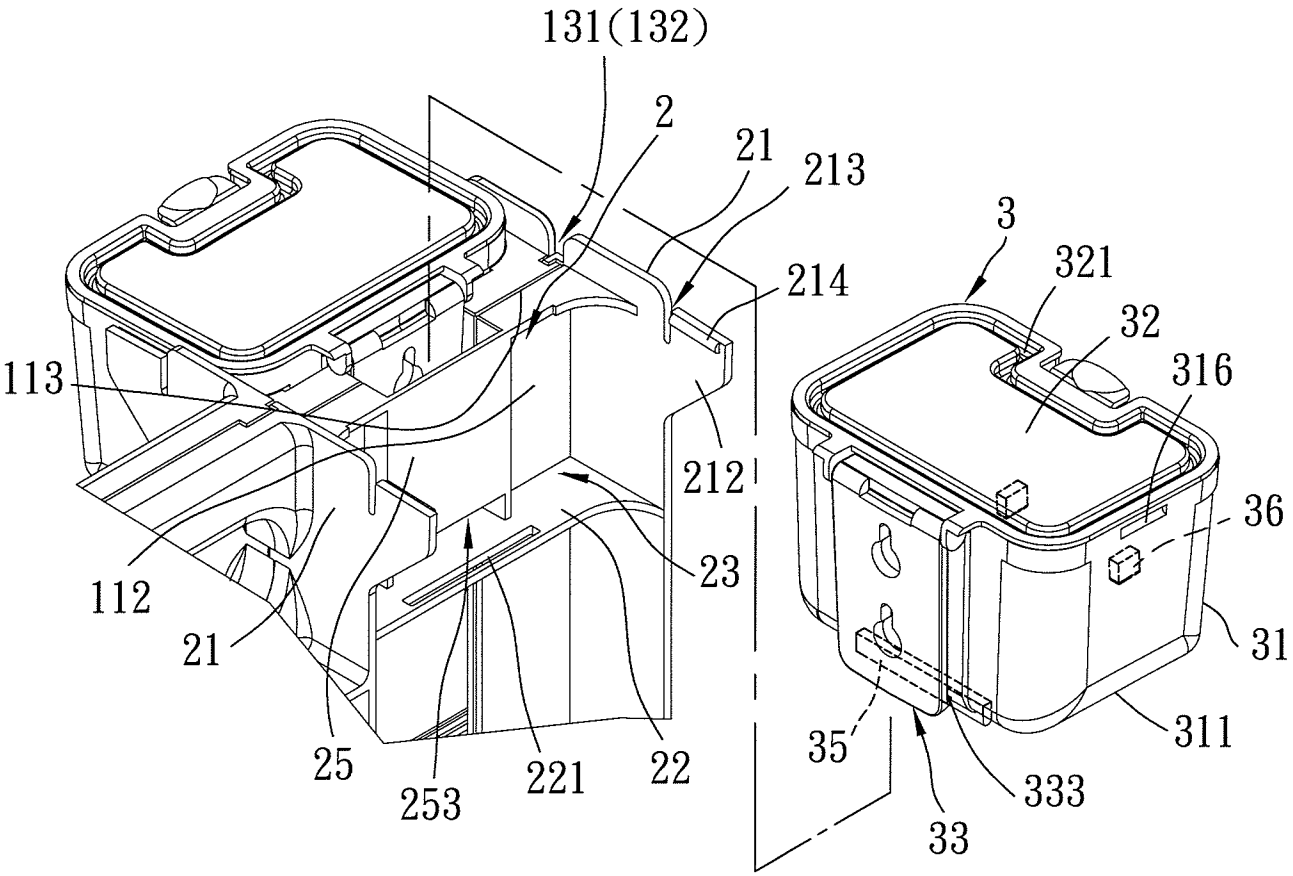
FIG. 3 is a fragmentary perspective view of the first preferred embodiment.

As shown in FIG. 3, a pair of bracket walls 21 are disposed to extend from each of the first and second flank segments 2 in the transverse direction, and are spaced apart from each other in the longitudinal direction. A rack wall 22 is disposed to extend in the longitudinal direction between the bracket walls 21 so as to define thereamong a holding space 23. An uprightly retaining clearance 253 is further provided between the rack wall 22 and a corresponding one of the first and second indented regions 25 in the upright direction. Each of the bracket walls 21 has an engaging protrusion 214 disposed on outwardly extending portion 212 thereof, and a slit 213 formed to vest the bracket walls 21 with a flexibility to flare upwardly for facilitating placement of a container body 31 of the respective modular container 3 in the holding space 23. The rack wall 22 has a longitudinally extended slot 221.

Each of the modular containers 3 includes a clip lug 33 extending downwardly from an upper edge of the container body 31 to be clippable on the corresponding one of the first and second indented regions 25, and a lid 32 configured to cover an access opening of the container body 31 at the upper edge. With reference to FIG. 5, the clip lug 33 extends downwardly to terminate at a hook-like lower retained end 333 which can extend into the uprightly retaining clearance 253. The container body 31 has a positioning insert 35 disposed on a bottom wall 311 thereof to be engaged in the longitudinally extended slot 221 so as to position the corresponding modular container 3 on the rack wall 22. Also, the container body 31 has two engaging grooves 316 configured to mate with the engaging protrusions 214, respectively, of the corresponding bracket walls 21 so as to permit the container body 31 to be releasably press-fitted onto the bracket walls 21. Further, the container body 31 has two supporting studs 36 which are disposed on the bottom wall 311, and which are displaced from the positioning insert 35 so as to permit the bottom wall 311 to be placed on ground more evenly.

When it is desired to assemble each of the modular containers 3 to the respective flank segment 2, the clip lug 33 is pressed open to clip on the corresponding indented region 25 to bring the positioning insert 35 into engagement in the longitudinally extended slot 221, and the lower retained end 333 into snapping on a lower edge of the indented region 25 by the biasing action of the clip lug 33, thereby securely hanging up the container body 31 while firmly positioning it on the corresponding shelf 10. Thus, each of the modular containers 3 can be firmly retained on the shelf 10 during carrying of the portable tool storing device. In use, the modular container 3 can be directly detached from the corresponding indented region 25 without the need to separate the shelves 10 from each other, and can be clipped on a belt of trousers of a user so as to facilitate carrying and accessing to a desired tool within the container body 31. Besides, the desired tool can be taken out from the container body 31 without the need to detach the container 30 from the shelf 10 or open the combined shelves 10. As a result, the workability of the portable tool storing device is improved.

Furthermore, by virtue of the supporting studs 36 of each container 3, the bottom wall 311 of the container body 31 can be placed on a ground surface more evenly. Also, the supporting studs 36 of the lowermost containers 3 on the shelf 10 permit the shelf 10 to stand uprightly and firmly. Additionally, the positioning insert 35 and the supporting studs 36 of each container 3 are configured to be inserted into a surrounding groove 321 (as shown in FIG. 3) formed in the lid 32 of a lower one of the containers 3 when the containers 3 are stacked.

Figure 6:
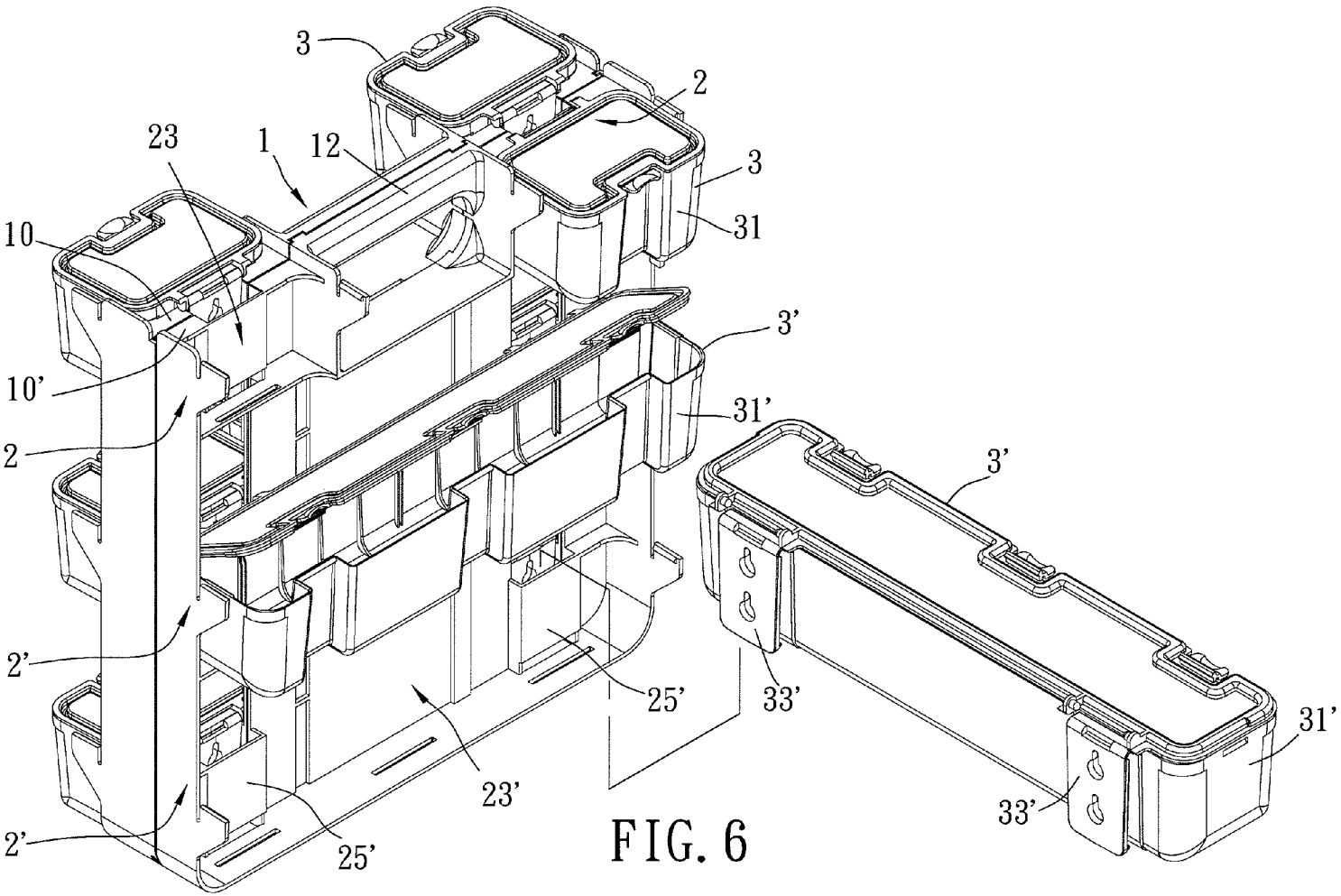
FIG. 6 is a perspective view of the second preferred embodiment of a portable tool storing device according to this invention.

Referring to FIG. 6, the second preferred embodiment of the portable tool storing device according to this invention is similar to the first embodiment, except that the first modular shelf 10' further has two elongated flank segments 2', each of which is elongated in the longitudinal direction to define an elongated holding space 23' and has two indented regions 25'. Additionally, two elongated modular containers 3' are disposed to be assembled to the elongated flank segments 2', respectively. Each elongated modular containers 3' has two clip lugs 33' disposed to be clipped on the indented regions 25', respectively so as to bring the container body 31' into fitting engagement in the elongated holding space 23'.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A portable tool storing device comprising:

a first modular shelf having first top and bottom ends opposite to each other in an upright direction, and first outward and inward surfaces opposite to each other in a transverse direction relative to the upright direction, said first modular shelf including a first middle wall which has a first crosspiece disposed at said first top end, a plurality of first flank segments which are disposed to flank said first middle wall in a longitudinal direction transverse to the upright and transverse directions, and which are spaced apart from each other in the upright direction, each of said first flank segments having a first indented region which is offset from said first inward surface in the transverse direction, and a male joint member disposed on said first inward surface;

a second modular shelf having second top and bottom ends opposite to each other in the upright direction, and second outward and inward surfaces opposite to each other in the transverse direction, said second modular shelf including a second middle wall which has a second crosspiece disposed at said second top end, a plurality of second flank segments which are disposed to flank said second middle wall in the longitudinal direction, and which are spaced apart from each other in the upright direction, each of said second flank segments having a second indented region which is offset from said second inward surface in the transverse direction, and a female joint member disposed on said second inward surface, and configured such that said first and second middle walls are brought into fitting engagement with each other in the upright direction to be placed in back-to-back engagement so as to permit said first and second crosspieces to be juxtaposed to and combined with each other so as to form a handle; and a plurality of modular containers, each including a container body and a clip lug extending downwardly from an upper edge of said container body wherein the clip lug of each modular container is clipped on a corresponding one of said first and second indented regions so that the modular containers are stored in an upright position with each clip lug extending downwardly parallel to the height of the indented regions.

2. The portable tool storing device according to claim 1, wherein said male and female joint members are configured to permit corresponding ones of said first and second indented regions to confront each other in the transverse direction when said male and female joint members are fittingly engaged with each other.

3. The portable tool storing device according to claim 2, wherein each of said first and second modular shelves includes a plurality of pairs of bracket walls, said bracket walls of each pair extending from a corresponding one of said first and second flank segments in the transverse direction and being spaced apart from each other in the longitudinal direction, and a rack wall extending in the longitudinal direction, disposed between said bracket walls to de fine thereamong a holding space, and spaced apart from a corresponding one of said first and second indented regions in the upright direction by an uprightly retaining clearance;

said clip lug of each of said modular containers extending downwardly to terminate at a lower retained end which is configured to extend into said uprightly retaining clearance to be snapped on a lower edge of the corresponding one of said first and second indented regions when said clip lug is clipped on the corresponding one of said first and second indented regions.

4. The portable tool storing device according to claim 3, wherein said rack wall has a longitudinally extended slot, said container body having a positioning insert which is disposed on a bottom wall of said container body, and which is configured to be engaged in said longitudinally extended slot when said clip lug is clipped on the corresponding one of said first and second indented regions so as to position a corresponding one of said modular containers on said rack wall.

5. The portable tool storing device according to claim 4, wherein said bracket walls are configured to flare upwardly to facilitate placement of said container body in said holding space, and have engaging protrusions disposed thereon, said container body having two engaging grooves which are configured to mate with said engaging protrusions, respectively, so as to permit said container body to be releasably press-fitted onto said bracket walls.

6. The portable tool storing device according to claim 4, wherein said container body of each of said modular containers has two supporting studs which are disposed on said bottom wall, and which are displaced from said positioning insert so as to permit said bottom wall to be placed on ground more evenly.

7. The portable tool storing device according to claim 1, wherein each of said modular containers has a lid which is configured to cover an access opening of said container body.

* * * * *